US005732877A

United States Patent [19]

Lee

[11] Patent Number: 5,732,877

[45] Date of Patent: Mar. 31, 1998

[54] ENVELOPE WITH OPENABLE STRUCTURE

[76] Inventor: Chung Hsiao Lee, No. 30, Jang Her Rd., 1 Sec., Jang Huah, Taiwan

[21] Appl. No.: 662,884

[22] Filed: Jun. 13, 1996

[51] Int. Cl.[6] ..... B65D 27/38

[52] U.S. Cl. ..... 229/311

[58] Field of Search ..... 229/308, 309, 229/310, 311

[56] References Cited

U.S. PATENT DOCUMENTS

| | | | |
|---|---|---|---|
| 1,176,640 | 3/1916 | Barber | 229/311 |
| 2,007,625 | 7/1935 | Walters | 229/309 |
| 2,298,616 | 10/1942 | Chandler | 229/308 |
| 2,956,727 | 10/1960 | Chevan et al. | 229/309 |
| 3,394,872 | 7/1968 | Robak | 229/309 |
| 3,653,585 | 4/1972 | Kazaros | 229/309 |
| 4,781,296 | 11/1988 | Morris et al. | 229/309 X |

FOREIGN PATENT DOCUMENTS

| | | | |
|---|---|---|---|
| 2501164 | 9/1982 | France | 229/311 |

*Primary Examiner*—Jes F. Pascua

*Attorney, Agent, or Firm*—David & Raymond; Raymond Y. Chan

[57] ABSTRACT

An envelope with openable structure includes a front panel, a back panel and a closure flap. The front panel has a front inner and a front outer opposed surface, a front top edge, a front bottom edge, and a front first and a front second opposed side edge. The back panel has a back inner and a back outer opposed surface, a back top edge, a back bottom edge connected to said front bottom edge of said front panel to form a bottom folding line, and a back first and a back second opposed side edge connected to said front first and second side edges respectively to form a first and a second side folding line respectively. The closure flap is extended from said front top edge of said front panel and forms a front folding line therebetween for overlapping and adhering onto said back outer surface of said back panel. A tough and durable tearing member, having a predetermined width and length, is affixed within said envelope at a position adjacent and parallel to one of said folding lines between said front and back panels, and that said tearing member further has at least an end tag portion extending outside said envelope for grasping, thereby by tearing said tearing member along said back folding line, a smooth, neat and full cut is achieved to open said envelope.

1 Claim, 8 Drawing Sheets

ENVELOPE WITH OPENABLE STRUCTURE

BACKGROUND OF THE PRESENT INVENTION

The present invention relates to envelopes, and more particularly to an envelope with openable structure for enabling the envelope to be opened quickly, easily and safely to achieve a smooth and neat cut to an edge thereof for a full access to its interior.

It is really difficult to open a conventional sealed envelope by free hand without any assisting instrument. Therefore, conventional sealed envelopes require a specific envelope opener, such as a knife with two sharpened edges inserting at one comer of an envelope to shear at least one folded edge portion thereof. Another well known method of opening an sealed envelope is to cut off a side edge portion thereof by means of a pair of scissors. The main shortcoming of such conventional methods is that the shearing or cutting of the folded edge of the envelope may shear a folded edge of the interior document simultaneously. In addition, the operation of the envelope opener or scissors is quite dangerous, especially for a children.

In order to open an envelope independently, various improved quick opening envelopes were invented for facilitating their opening operation. An envelope construction having hidden tearable structure is disclosed by Alien U.S. Pat. No. 4,212,396 which provides a tear member delimited by a pair of spaced lines at perforations with cut lines connected and located at opposite ends of the tear member. This tear member overlies top edge of the insert so that, as it is peeled away, an edge is exposed for removal of the insert. However, most letter envelopes are made of softer paper so that, it is difficult to tear away the entire tear member along the pair of spaced hidden lines. In most circumstances, one can only tear off portion of the tear member before it is broken. Therefore, such tear member style envelopes are usually constructed in those large paperboard envelopes which are made of rigid paperboard, such as the A4 or legal document envelopes.

More prior constructions having exposed tear lines are shown by Hiersteiner U.S. Pat. No. 3,733,025; Jacob U.S. Pat. No. 4,607,749; Meeker U.S. Pat. No. 4,470,511 and 4,492,308; Kim U.S. Pat. No. 4,729,507. These prior envelope constructions bear the drawbacks as follows.

Hiersteiner U.S. Pat. No. 3,733,025 disclosed an easy opening envelope which can only be sealed by a pair of releasable adhesive strips positioned between the tear member and the back panel of the envelope. Hence, such structure is unable to construct with conventional adhesive envelopes and, moreover, no mucilage, glue or adhesive paste is able to apply on the back panel of the envelope for firmly permanent sealing of the envelope as in usual manner.

Other prior easily openable envelopes as mentioned above are provided with a tear away portion extending there across in a predetermined area of the closure flap, the back panel or the back bottom flap. The prior openable envelope is opened in the natural way by grasping the flap and pulling upwardly to cause the envelope to open along a tear line of various pattern. Although these improved openable envelopes can be firmly permanent sealed by glue or paste, they often result in the tearing of the envelope, thereby leaving a ragged unsightly condition.

No matter which kind of the prior openable envelope construction are used, they all bear a common drawback that at least a hidden tear line must be constructed on the envelope which unavoidably damages the structure thereof and highly decreases the duration and toughness thereof.

SUMMARY OF THE PRESENT INVENTION

It is, accordingly, a main object of the present invention to provide an envelope with openable structure which has no perforation formed on the envelope. The openable structure enables the envelope to be opened quickly, easily and safely.

It is another object of the present invention to provide an envelope with openable structure which can provide a smooth, neat and full cut of a predetermined folded edge of the envelope for a full access to its interior.

It is still a further object of the present invention to provide an envelope with openable structure which can be firmly permanent sealed by glue and adhesive paste.

Accordingly, an envelope with openable structure of the present invention comprises a back panel having a back inner and a back outer opposed surface, a back bottom edge, a back top edge, and a back first and a back second opposed side edge; a from panel having a front inner and a front outer opposed surface, a front top edge, a front bottom edge connected to the back bottom edge, and a from first and a front second opposed side edge connected to the back first and second opposed side edges respectively. A closure flap is extended from the front top edge of the front panel and forms a folding line therebetween for overlapping and adhering to the back outer surface of back panel, the closure flap having a bottom free edge which is parallel and adjacent to the front top edge of the front panel. A tough and durable tearing member has a predetermined width and a length longer than the front top edge of the front panel, which is affixed to the bottom free edge of the closure flap along the from top edge of the front panel, wherein at least an end tag portion is provided at one end of the tearing member. The end tag portion is extended outside the closure flap for grasping. Therefore, by tearing the tearing member along the folding line, a smooth, neat and full cut is achieved along the folding line thereof for a full access to its interior content.

Another embodiment of the present invention provides an envelope with openable structure comprises a back panel having a back inner and a back outer opposed surface, a back bottom edge, a flat back top edge, a back folding member extending from the back top edge and forming a back folding line therebetween, and a back first and a back second opposed side edge. The back folding member is folded frontwards to overlap and adhere to the back inner surface of the back panel. A front panel has a front inner and a front outer opposed surface, a front top edge, a front bottom edge connected to the back bottom edge, and a front first and a front second opposed side edge connected to the back first and second opposed side edges respectively. A closure flap is extended from the front top edge of the front panel and forms a front folding line therebetween for overlapping and adhering to the back outer surface of back panel. A tough and durable tearing member has a predetermined width and a length longer than the back folding line of the back folding member, which is affixed between the back folding member and the back inner surface of the back panel along the back folding line, wherein at least an end tag portion is provided at one end of the tearing member. The end tag portion is extended outside the back folding member for grasping. Therefore, by tearing the tearing member along the back folding line, the back folding line as well as the front folding line will be fully cut off simultaneously, smoothly and neatly to form an opening for a full access to its interior content.

DETAILED DESCRIPTION OF THE PREFERRED EMBODIMENT

Figure 1A:
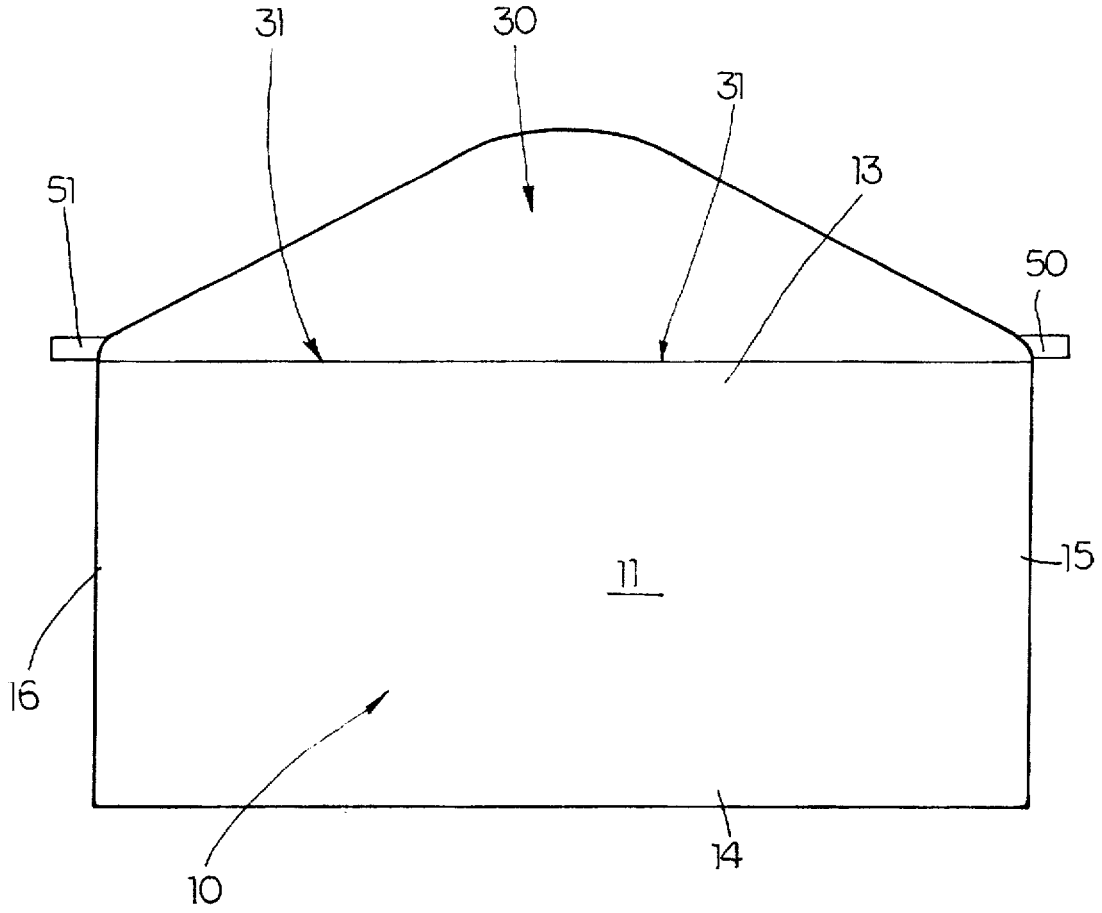
FIG. 1A is a front view of an envelope with openable structure according to a first preferred embodiment of the present invention, in which the closure flap is unfolded.
Figure 1B:
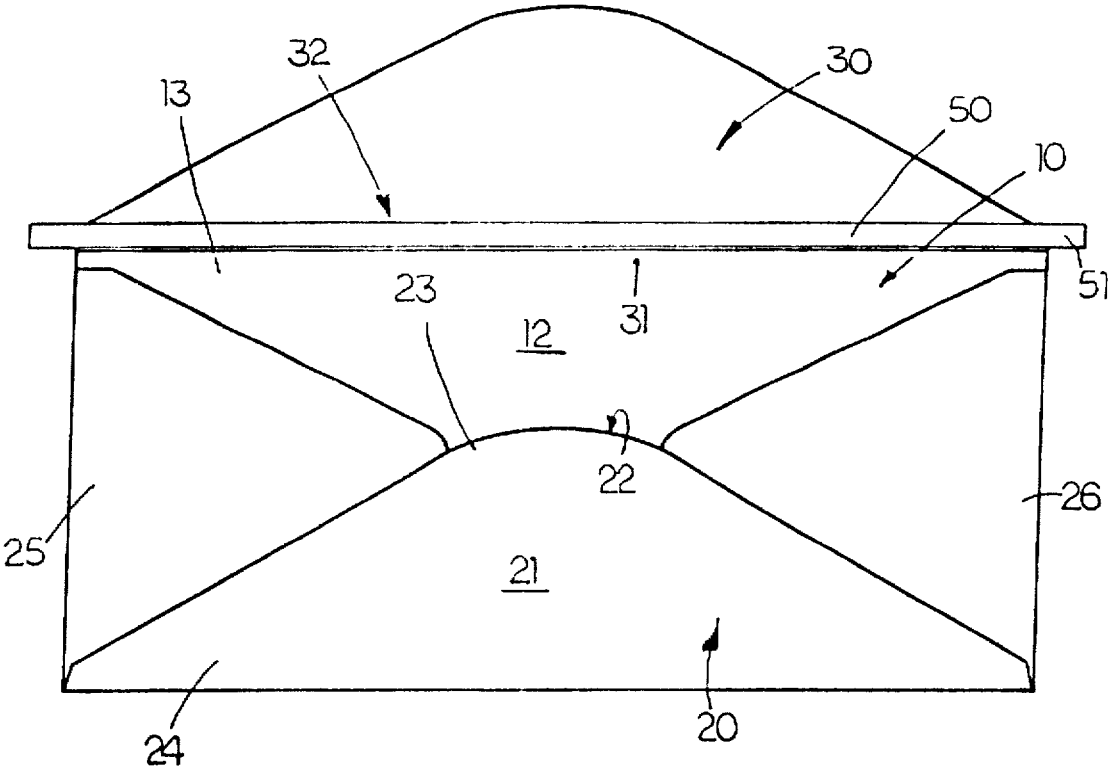
FIG. 1B is a back view of FIG. 1A.
Figure 1C:
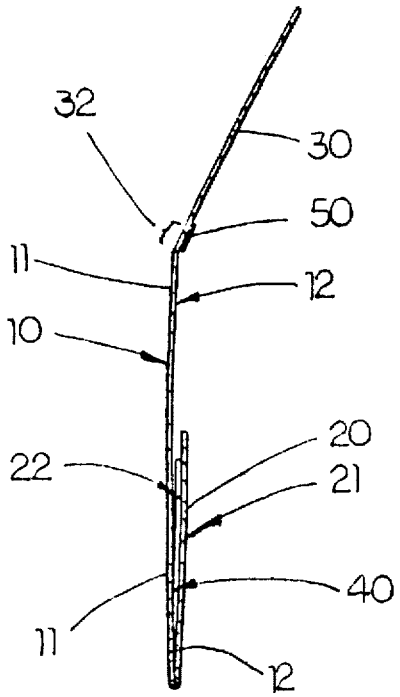
FIG. 1C is a sectional end view of FIG. 1A.

Referring to FIGS. 1A, 1B and 1C, an envelope with openable structure according to a first preferred embodiment of the present invention, which is formed by die cutting from a larger piece of paper or paperboard in an usual manner, comprises a front panel 10, a back panel 20 and a closure flap 30.

The front panel 10 has a front inner and a front outer opposed surface 11 and 12, a front top edge 13, a front bottom edge 14, and a front first and a front second opposed side edge 15, 16. The back panel 20 has a back inner and a back outer opposed surface 21 and 22, a back top edge 23, a back bottom edge 24 connected to the front bottom edge 14 of the front panel 10, and a back first and a back second opposed side edge 25 and 26 connected to the front first and second side edges 15, 16 respectively. Therefore, a receiving pocket 40 is defined between the front inner surface 12 of the front panel 10 and the back inner surface 22 of the back panel 20, as shown in FIG. 1C, for receiving interior documents.

Figure 2A:
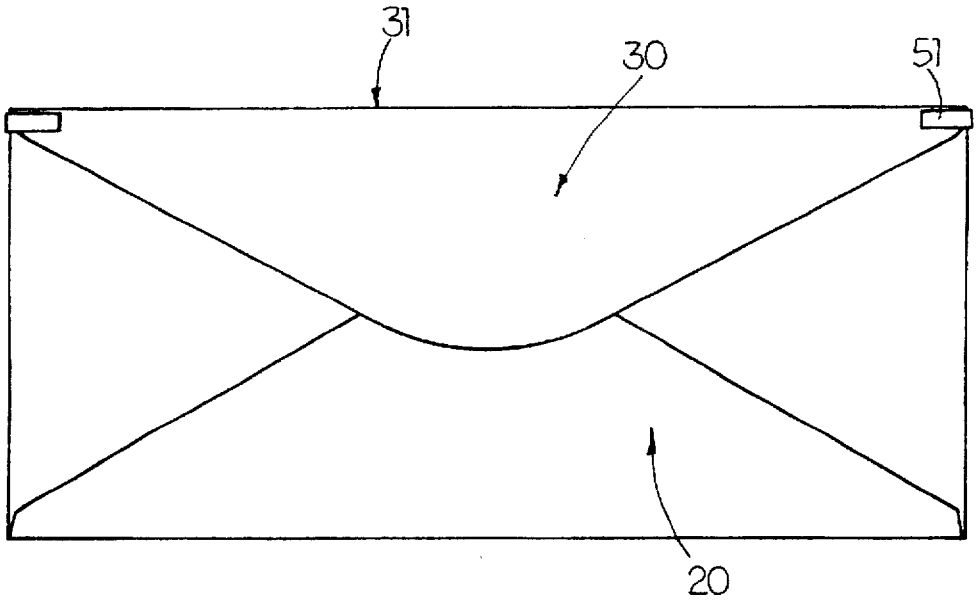
FIG. 2A is a back view of an envelope with openable structure according to the above first preferred embodiment of the present invention, in which the closure flap is folded backwards to overlap the back panel.
Figure 2B:
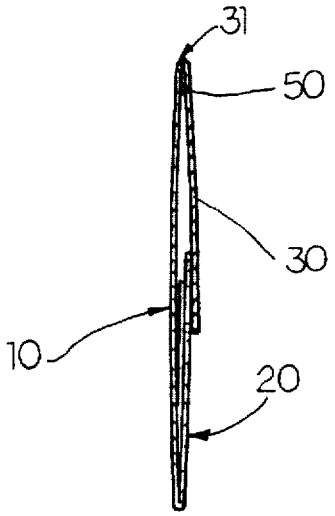
FIG. 2B is a sectional end view of FIG. 2A.

The closure flap 30 is extended from the front top edge 13 of the front panel 10 and has a bottom free edge portion 32 which is parallel and adjacent to the front top edge 13 of the front panel 10, so that a folding line 31 is formed between the front top edge 13 of the front panel 10 and the bottom free edge portion 32 of the closure flap 30. The closure flap 30 can be folded backwards to overlap onto the back outer surface 21 of the back panel 20 for adhering thereon to seal the envelope, as shown in FIGS. 2A and 2B.

Since the nature of a folding line of a paper is weakened, it is more easily to tear off along the folding line than any other portion of the paper. Therefore, the main inventive concept of the present invention is to provide an additional means to a conventional envelope that, no matter it is a paper envelope or a paperboard envelope, one of the folding lines is adapted to cut off so as to provide an opening for full access to its interior content.

Figure 2C:
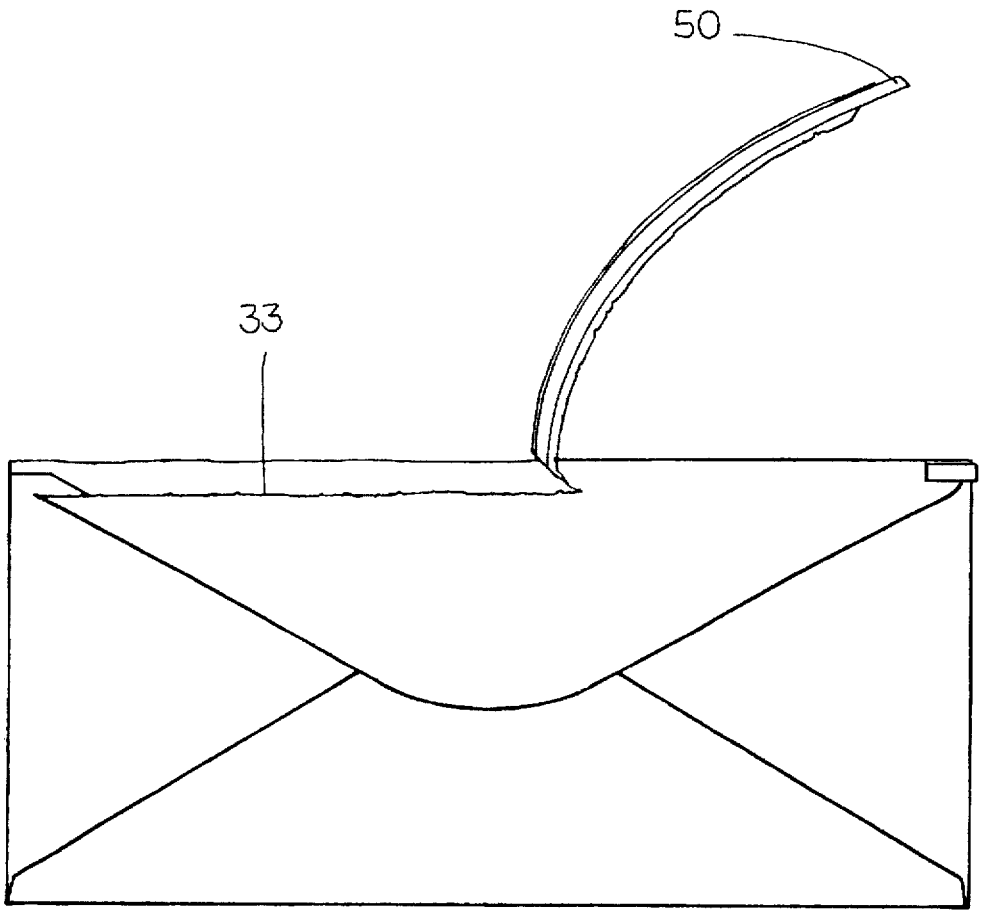
FIG. 2C is a schematic back view showing the tearing off operation of the tearing member.

The opening of the present invention comprises a tough and durable tearing member 50 having a predetermined width and a length longer than the folding line 31 positioned between the bottom free edge 32 of the closure flap 30 and the front top edge 13 of the front panel 10. The tearing member 50 is affixed to the bottom flee edge 32 of the closure flap 30 along the folding line 32. The tearing member 50 further has at least an end tag portion 51 provided at one end and extended outside the closure flap 30 for grasping. As shown in FIG. 2C, therefore, by tearing the tearing member 50 along the folding line 31, a smooth, neat and full cut is achieved along the folding line to form an opening 33 for a full access to its interior content and enabling an user to take the content out of the envelope.

In accordance with the present first embodiment, the tearing member 50 is a light and thin tearing strip made of strengthened and durable material such as aluminum foil, tin foil, plastic strip, reinforced and durable paper strip, or other similar material, which is adhered to the bottom free edge portion 32 of the closure flap 30 in such a manner that one edge of the tearing member 50 is alined with the folding line 31. Besides, two end tag portions 51 of the tearing member 50 are extended outside the closure flap 30 so that, the user can open the envelop easily, quickly, and smoothly by tearing either one of the end tags portions 51. Since no sharpened assistant tool such as envelope knife or scissors is required, the operation of opening the envelope of the present invention is thus more safely. Moreover, by means of the tearing member 50 which acts as a curing blade when it is tom along the folding line 31, an envelope with such openable structure according to the present invention can easily be cut off along the folding line 31 neatly and smoothly that, it just likes to be cut off by a pair of scissors or envelope opener.

Figure 3A:
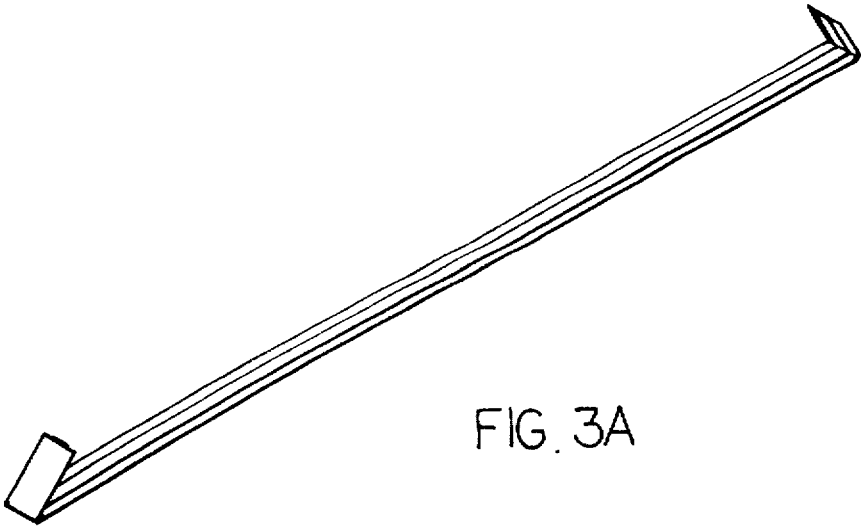
FIG. 3A is a perspective view of an alternative mode of the tearing member according to the above first preferred embodiment of the present invention.
Figure 3C:
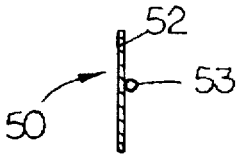
FIG. 3C is a sectional end view of another alternative mode of the tearing strip.
Figure 3B:
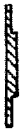
FIG. 3B is a sectional end view of FIG. 3A.

As shown in FIGS. 3A and 3B, an alternative mode of the tearing member 50 is illustrated, in which a longitudinal thickened portion is provided at either side of the tearing member 50 in order to further reinforce and strengthen the tearing member 50 for better tearing and cutting effect.

Figure 3D:
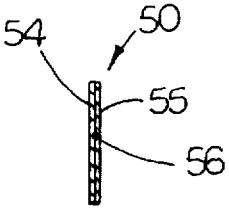
FIG. 3D is a sectional end view of a modification of the tearing member as shown in FIG. 3C.

As shown in FIG. 3C, another alternative mode of the tearing member 50 is illustrated. The tearing member 50 comprises a thin and narrow plastic tearing strip 52 and a reinforced thread member 53, such as a metal or cotton thread, having the same length of the tearing strip 52 integrally adhered on one side of the tearing strip 52. As shown in FIG. 3D, the tearing member 50 comprises two thin plastic or metal strips 54, 55 and a reinforced thread member 56 positioned therebetween for adhering together to form a strengthened and integral strip. Such modifications are also practical in the present invention.

Figure 4A:
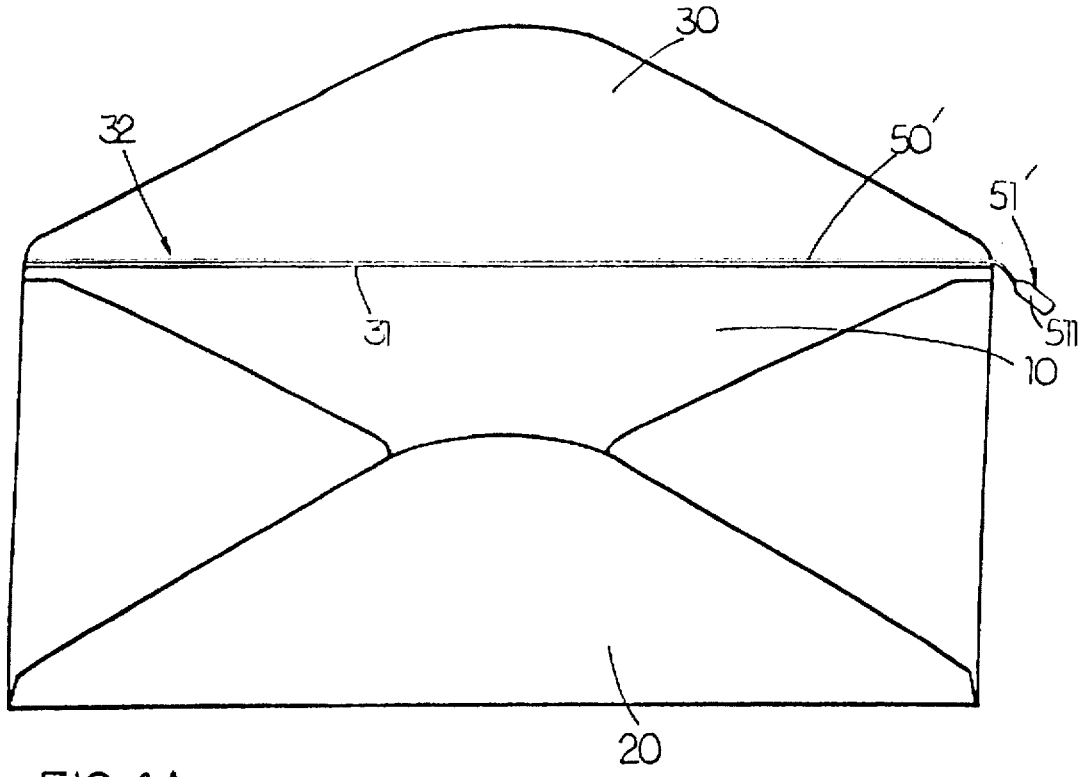
FIG. 4A is a back view of an envelope with openable structure according to a second preferred embodiment of the present invention, in which the closure flap is unfolded.
Figure 4B:
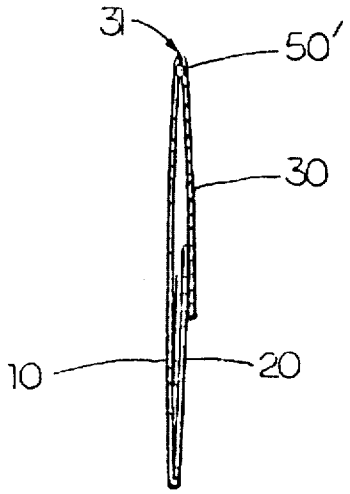
FIG. 4B is a sectional end view of the second preferred embodiment of the present invention, in which the closure flap is folded backwards to overlap the back panel.

FIGS. 4A and 4B illustrate a second preferred embodiment of the present invention, in which the tearing member is a tearing wire 50' made of plastic, metal thread, or strengthened cotton thread. The tearing wire 50' is adhered to the bottom free edge 32 of the closure flap 30 adjacent to the folding line 31. Similarly, an envelope with such openable structure according to the present invention can easily be cut off to open by tearing an end tag portion 51' of the tearing wire 50' along the folding line 31 neatly and smoothly. Furthermore, the end tag portion 51' has an enlarged tag 511' for easier grasping by the user.

It is worth to mentioned that it is also possible to provide a top free edge portion on the top edge 13 of the front inner surface 12 of the front panel 10 for affixing the tearing member 50 or the tearing wire 50' thereon. A satisfactory tearing and cutting effect can also be achieved to open the envelope.

Figure 5A:
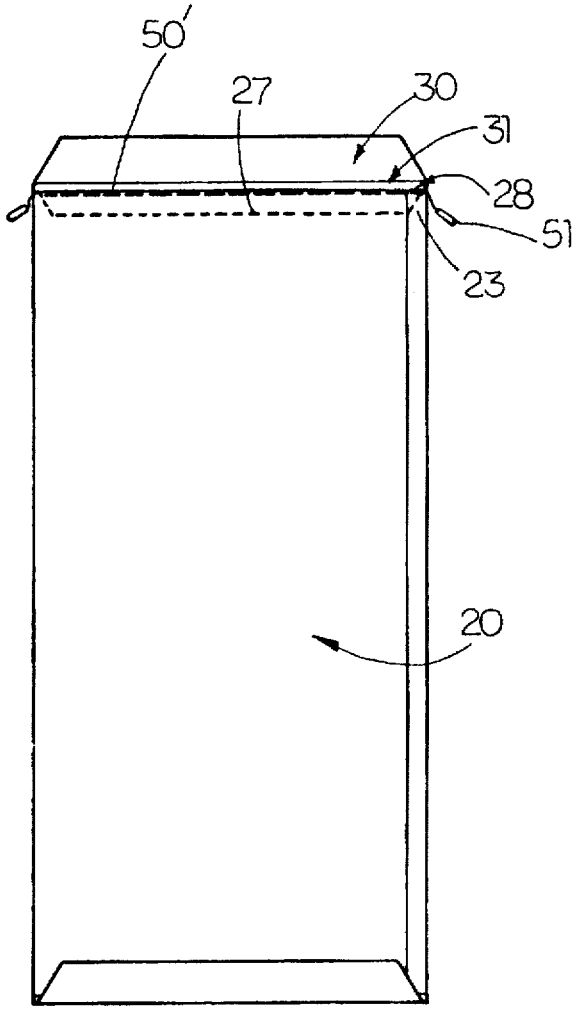
FIG. 5A is a back view of an envelope with openable structure according to a third preferred embodiment of the present invention respectively, in which the closure flap is unfolded.
Figure 5B:
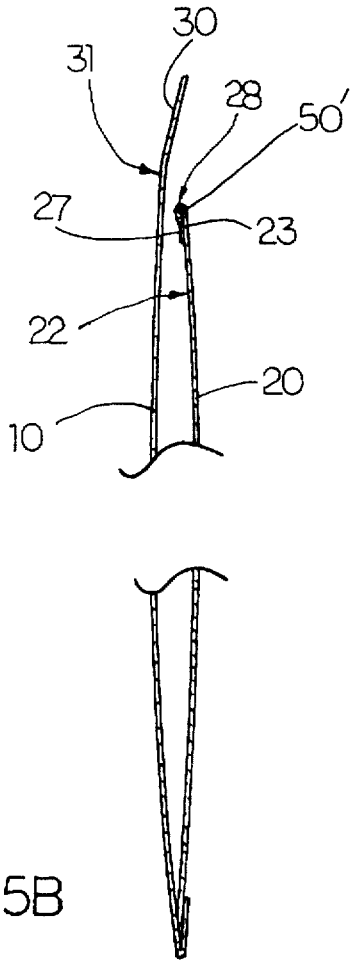
FIG. 5B is a partial sectional end view of FIG. 5A.

To those paper envelope or paperboard envelope having a flat back top edge 23 on the back panel 20, referring to FIGS. 5A and 5B, a preferred third embodiment of the present invention can be applied. The back panel 20 of such envelope further comprises a back folding member 27 extending from the flat back top edge 23 of the back panel 20 and forming a back folding line 28 therebetween which is parallel to the front folding line 31. The back folding member is folded frontwards to overlap and adhere to the back inner surface 22 of the back panel 20. In this circumstances, the tough and durable tearing member, which is preferred to be the tearing strip 50 or the tearing wire 50' as mentioned above, has a length longer than the back folding line 28 of the back folding member 27. As shown in FIGS. 5A and 5B, the tearing wire 50' is preferred to be utilized in this third embodiment, which is affixed between the back folding member 27 and the back inner surface 22 of the back panel 20 along the back folding line 28. Besides, at least an end tag portion 51' is also extended outside the back panel 20 for grasping, thereby by tearing the tearing wire 50' along the back folding line 28, the back folding line 28 as well as the front folding fine 31 will be fully cut off simultaneously, smoothly and neatly to form an opening for a full access to its interior content.

Figure 6A:
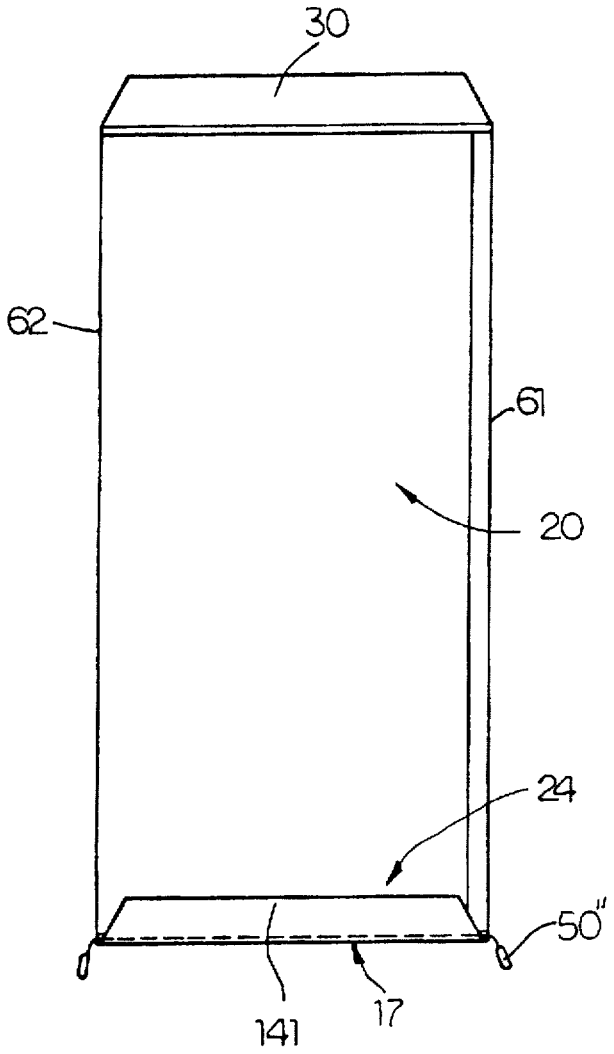
FIG. 6A is a back view of an envelope with openable structure according to a fourth preferred embodiment of the present invention.
Figure 6B:
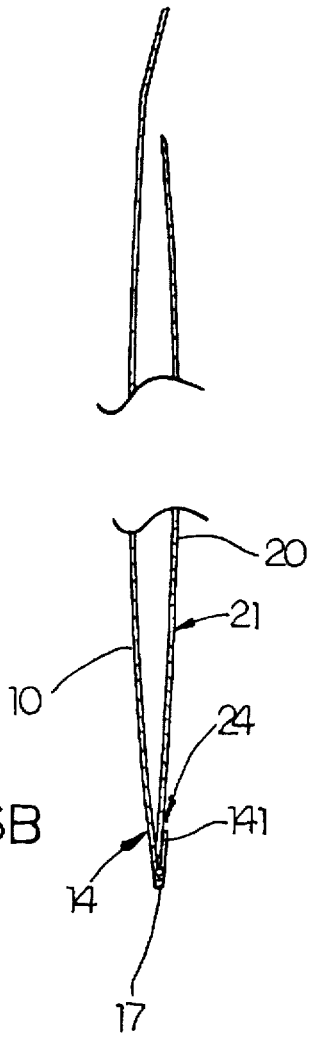
FIG. 6B is a sectional end view of FIG. 6A.

Although the three embodiments described above provide the tearing member 50 affixed near the closure flap 30, in fact, after the envelope is sealed, the top, bottom and two side edges of the envelope have the same sealed nature. Therefore, the tearing member 50 can be pre-affixed on the inner surface of the front or back panel, adjacent and parallel to either the front folding line, a bottom folding fine formed between the front and back bottom edges of the front panel and the back panel, or the two side folding lines formed between the front and back side edges of the front panel and the back panel. Such modification is illustrated in FIGS. 6A and 6B as an example. In this fourth embodiment, a tearing wire 50" is affixed to an inner surface of a bottom folding member 141 which is extended from the front bottom edge 14 of the front panel 10 and adhered on the back bottom edge 24 of the back panel 20. Accordingly, by tearing the tearing wire 50" along a bottom folding line 17 positioned between the front bottom edge 14 and the bottom folding member 141, the bottom folding line 17 will be fully cut off smoothly and neatly to form an opening for a full access to its interior content. It should be understood that such openable structure is also able to constructed on the two side folding lines 61, 62,

I claim:

1. An envelope with openable structure, comprising a front panel having a front inner and a front outer opposed surface, a front top edge, a front bottom edge, and a front first and a front second opposed side edge;

a back panel having a back inner and a back outer opposed surface, a flat back top edge, a back folding member extending from said back top edge and forming a back folding line therebetween, a back bottom edge connected to said front bottom edge of said front panel, and a back first and a back second opposed side edge connected to said front and second side edges respectively, wherein said back folding member is folded frontwards to overlap and adhered onto said back inner surface of said back panel;

a closure flap extending from said front top edge of said front panel and forming a front folding line between said closure flap and said front top edge of said front panel for overlapping and adhering to said back outer surface of said back panel; and a tough and durable tearing wire, having a predetermined width and a length longer than said back folding line, being affixed between said back folding member and said back inner surface of said back panel along said back folding line by adhering to a bottom free edge of said back folding member adjacent to and along said back folding line, and that said tearing wire further has at least an end tag portion extending outside said back folding member for grasping, thereby by tearing said tearing wire along said back folding line, said back folding line as well as said front folding line is fully cut off simultaneously, smoothly and neatly to form an opening.

* * * * *